US005125217A

United States Patent [19]

Fukuda

[11] Patent Number: 5,125,217

[45] Date of Patent: Jun. 30, 1992

[54] APPARATUS FOR PULLING BAG-MAKING MATERIAL FOR FORM-FILL-SEAL PACKAGING MACHINE

[75] Inventor: Masao Fukuda, Shiga, Japan

[73] Assignee: Ishida Scales Mfg. Co. Ltd., Sakyo, Japan

[21] Appl. No.: 734,898

[22] Filed: Jul. 24, 1991

[30] Foreign Application Priority Data

Jul. 31, 1990 [JP] Japan ..... 2-81936[U]
Oct. 29, 1990 [JP] Japan ..... 2-291355

[51] Int. Cl.[5] ..... B65B 41/12; B65B 9/20

[52] U.S. Cl. ..... 53/551; 53/389.5; 198/689.1; 226/172

[58] Field of Search ..... 53/450, 451, 550, 551, 53/552, 389.2, 389.4, 389.5; 198/464.3, 471.1, 626.3, 626.4, 626.5, 689.1, 811; 226/95, 171, 176, 180, 191

[56] References Cited

U.S. PATENT DOCUMENTS 3,202,302 8/1965 Insolio ..... 198/689.1 X
3,878,883 4/1975 Hazelett et al. ..... 226/172 X
3,915,291 10/1975 Vogts ..... 198/689.1 X
3,929,268 12/1975 Gross ..... 226/176
4,136,505 1/1979 Putnam, Jr. et al. .
4,288,965 9/1981 James ..... 53/551 X
4,546,596 10/1985 Cherney ..... 53/551 X
4,578,931 4/1986 Roovers ..... 53/551
4,620,409 11/1986 McElvy ..... 226/172 X
4,691,499 9/1987 Umeda et al. ..... 53/451
4,727,707 3/1988 Hadden ..... 53/552 X
4,775,088 10/1988 Seko ..... 226/172
4,840,012 6/1989 Boeckmann ..... 53/451 X

FOREIGN PATENT DOCUMENTS 82-01359 4/1982 PCT Int'l Appl. .
2096091 10/1982 United Kingdom .

*Primary Examiner*—Horace M. Culver

[57] ABSTRACT

A film-pulling apparatus for a packaging machine includes guide plates with arcuate inner surfaces. A cylindrically formed bag-making film material is pulled down inside these guide plates while being adsorbed to their inner surfaces by the negative pressure inside suction vacuum chambers flanking the path of the film material. A pair of pull-down belts is vertically stretched between pulleys adjacent to the path and over the suction vacuum chambers. The belts have many holes such that the negative pressure from the suction vacuum chambers is communicated to the film material through the pull-down belts as the pulleys rotate to pull down the film material. An auxiliary vacuum chamber is connected to the suction vacuum chamber through a normally closed valve such that the vacuum condition in the suction chamber can be quickly restored by opening this valve when an abnormal pressure condition in the suction vacuum chamber is detected. The axes of the pulleys are supported by axle bearings engaging with right-hand and left-hand screw parts of a turnbuckle such that the separation between the belts can be accurately adjusted by rotating the turnbuckle.

13 Claims, 5 Drawing Sheets

APPARATUS FOR PULLING BAG-MAKING MATERIAL FOR FORM-FILL-SEAL PACKAGING MACHINE

BACKGROUND OF THE INVENTION

This invention relates to an apparatus for pulling a web of flexible bag-making material for a packaging machine of the form-fill-seal type. More particularly, the invention relates to such an apparatus with an improved mechanism for positioning pull-down belts and transmitting power to the belts for a form-fill-seal packaging machine of the vertical pillow type which does not require the presence of a loading cylinder of a conventional type.

Conventional form-fill-seal packaging machines of the so-called vertical pillow type are usually comprised of a shoulder-shaped member disposed above a vertical cylinder. A web of belt-like elongated flexible thermoplastic film material, from which bags are to be formed, is pulled from a film supply roll and is wrapped around this vertical cylinder by means of the shoulder-shaped member. For this reason, this shoulder-shaped member is sometimes referred to as a former. The side edges of the belt-like film material are overlapped and these overlapped parts are thermally sealed as the film material is pulled down along the outer surface of the cylinder such that the film material is made into a tubular form. This sealing process is hereinafter referred to as the vertical sealing. A horizontally elongated heater is provided below the cylinder for a horizontal sealing process whereby the film material now in a tubular form is sealed horizontally into a bag-like form. In the meantime, articles to be packaged are dropped into this newly formed bag through the vertical cylinder which may therefore be referred to also as a loading cylinder.

In order to form bags of uniform height, such a bag-making apparatus as described above is generally provided with a pair of so-called pull-down belts for pulling down the film material by a constant distance. Such pull-down belts are generally provided with air cylinders and mechanical handles such that their separation can be varied for changing the size of the bags or for setting a new web to the machine. With the apparatus formed as described above, however, it is difficult to adjust the pressure to be applied onto the film material.

When a relatively large amount of articles is dropped into each bag, the use of a loading cylinder may not present a serious problem. When only a small amount is to be packaged individually, however, the thickness of the side wall of the cylinder itself may have the effect of significantly reducing the cross-sectional area through which the articles to be packaged can flow into the bag and this, in turn, adversely affects the efficiency of the packaging machine as a whole.

Moreover, a packaging machine of this type is usually provided with a lever-like member inside the film material so as to keep the bag in open position. Should such a member break, broken pieces thereof would be likely to remain inside the bag with packaged articles. If the loading cylinder is dispensed with, however, there arises the problem of accurately positioning the bags.

SUMMARY OF THE INVENTION

The general object of the present invention is to provide an improved form-fill-seal packaging machine. In view of the background described above, one of the more specific objects of the present invention is to provide a film-pulling mechanism for adjusting the pressure on the film material and pulling the material accurately without regard to its size. It is another object of the invention to provide a film-pulling apparatus for such a packaging machine without relying upon the use of a loading cylinder. A still another object of the invention is to provide such a film-pulling apparatus with which bags of different sizes can be formed and the sealing pressure on the bag-making material can be controlled easily and accurately.

An apparatus embodying the present invention with which the above and other objects may be accomplished is characterized as having guide plates below a former such that the bag-making film material rolled up into a cylindrical form by the former is guided inside these guild plates along their inner surfaces. In order to accomplish this, use is made of a pair of pull-down belts with holes therethrough and, in order to keep the film material adsorbed to the belts, suction vacuum chambers are provided such that the negative pressure therein can be communicated to the film material through the belts. An auxiliary vacuum chamber is provided such that, if the internal pressure of the suction vacuum chamber is abnormally increased and fails to keep the film material adsorbed to the inner surfaces of the guide plates, a normally closed valve between the auxiliary vacuum chamber and the suction vacuum chamber is opened automatically to quickly re-establish the desired vacuum condition inside the suction vacuum chamber.

For controlling the separation between a pair of pull-down belts, a turnbuckle is provided with two axle bearings engaging with its right-hand and left-hand screw parts. Each axle bearing rotatably supports the axis of a pulley for on of the pull-down belts such that the separation between the two pull-down belts in the direction of the turnbuckle can be controlled by rotating the turnbuckle. A torque communicating mechanism such as a Schmidt coupling is used to connect the shafts of the driver pulleys for the pull-down pulleys to the drive shaft of a belt-rotating motor. Similar connections may be effected to a heater belt for effecting vertical sealing such that the heater belt can be moved towards or away from the film material in a perpendicular direction to the separation between the pull-down belts and in accordance with the motion of the pull-down belts.

DETAILED DESCRIPTION OF THE INVENTION

Figure 1:
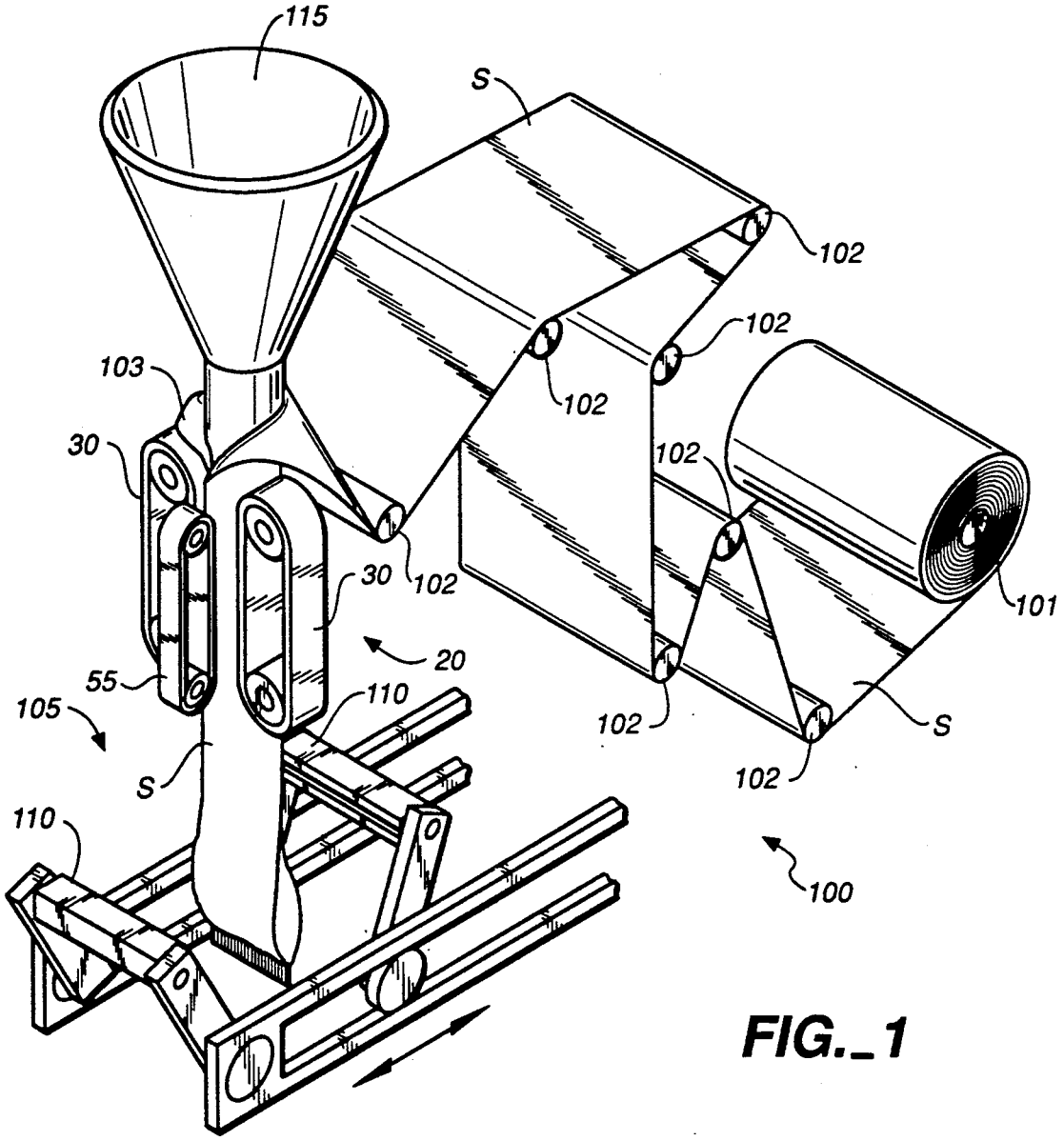
FIG. 1 is a schematic diagonal view of a part of a packaging machine which may include an apparatus of the present invention.

As schematically shown in FIG. 1, a form-fill-seal packaging machine 100 of the vertical pillow type is so called because a web of flexible thermoplastic film material S, which is unwound from a film supply roll 101 and guided by a plurality of guide rolls 102, is directed to a shoulder-shaped former 103 of a known kind and, after it is thereby formed into the shape of a tube, it is pulled vertically downward by a film-pulling apparatus 20 towards a horizontal sealer 105 disposed below the former 103. The side edges of the elongated film material S are overlapped by the former 103 and vertically sealed together by means of a vertical-seal belt (or a heat belt) 55 and the film material S now in the form of a tube is pulled down by means of a pair of pull-down belts 30 towards the horizontal sealer 105 below. The horizontal sealer 105 may include a pair of so-called seal jaws 110 which are horizontally elongated and adapted to seal the tubular film material horizontally to form a bag. In the meantime, articles to be packaged are dropped from a hopper 115 disposed above the former 103.

Figure 2:
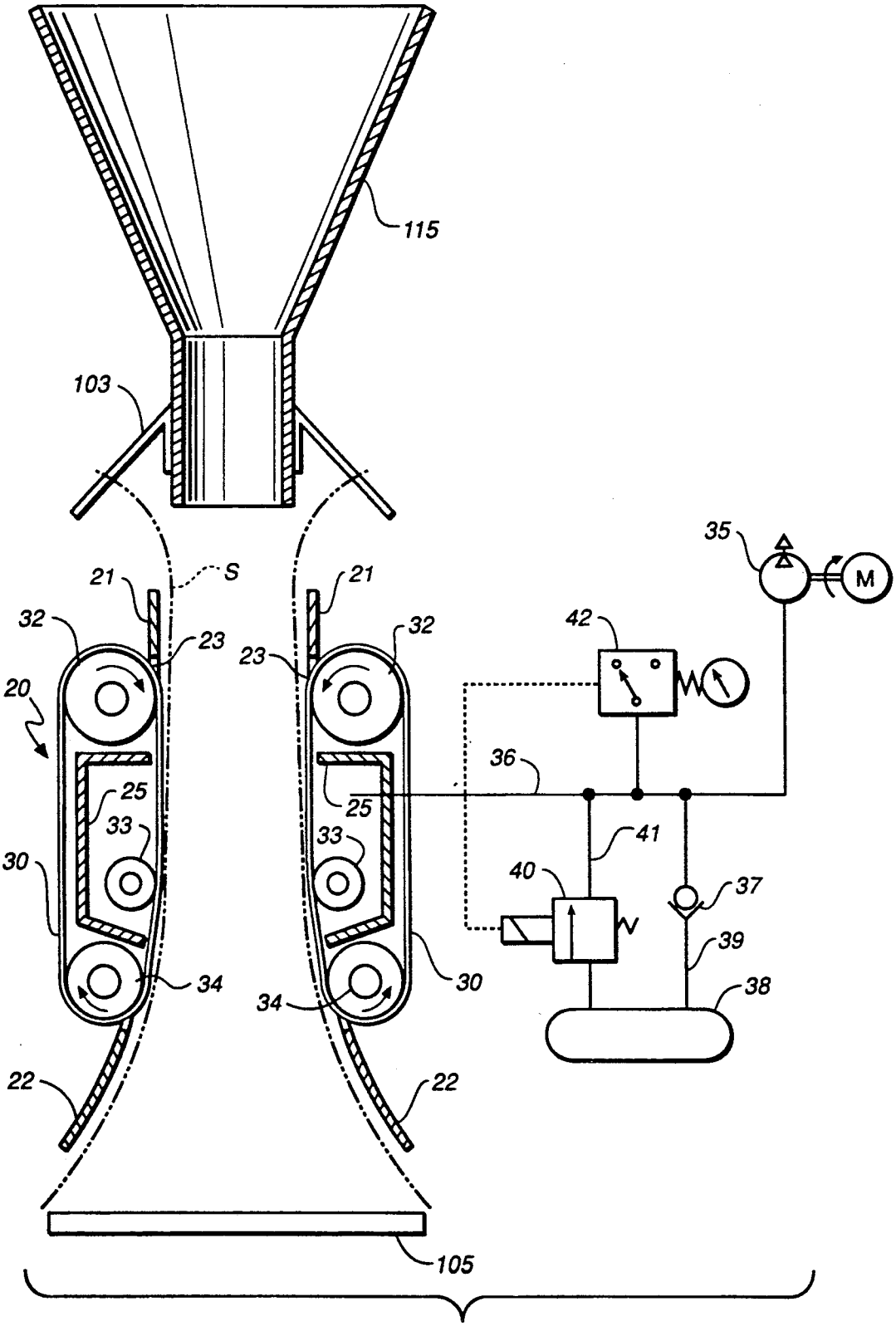
FIG. 2 is a combination of a schematic horizontal view of a film-pulling apparatus embodying the present invention for a form-fill-seal packaging machine and a block diagram showing its vacuum system.
Figure 3:
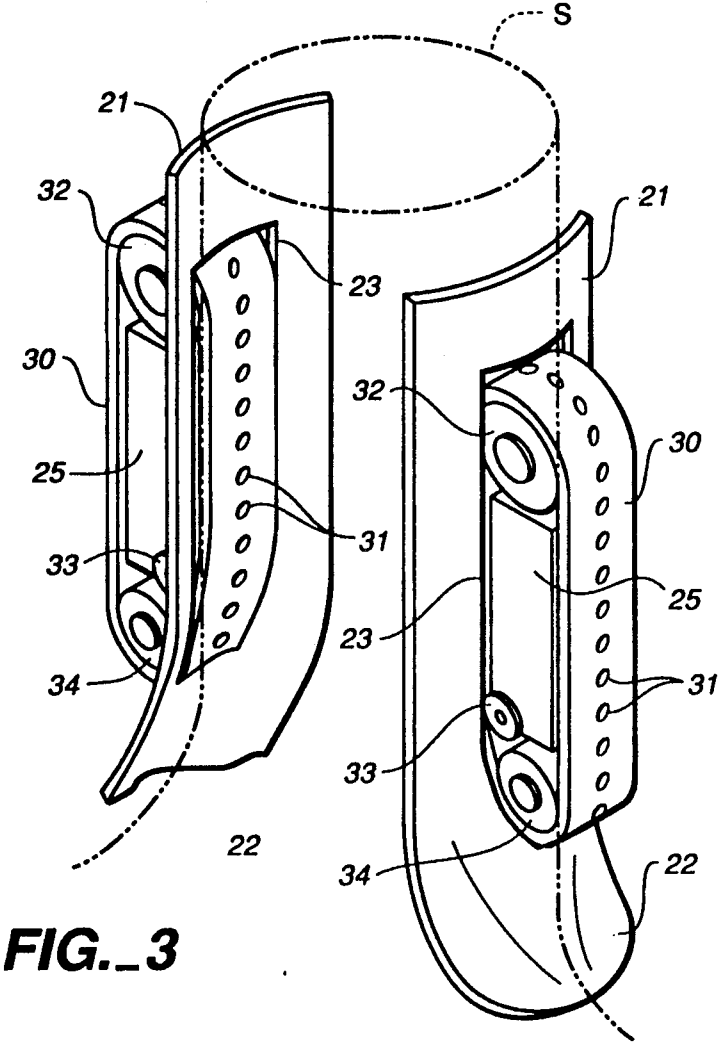
FIG. 3 is a perspective view of a portion of the apparatus shown in FIG. 2.

With reference concurrently next to FIGS. 1, 2 and 3, the film-pulling apparatus 20 according to a preferred embodiment of the present invention is disposed below the former 103 and above the horizontal sealer 105 (only schematically shown in FIG. 2) and is comprised of a vertically elongated guide plates 21 with an arcuate cross-sectional shape. Unistructurally formed lower parts (indicated by numerals 22) of these guide plates 21 are in the form of a skirt, radially extending outward with the radius of curvature of its cross-section increasing gradually downward such that the cross-sectional shape at the bottom is elliptical. Unlike the loading cylinder of a conventional packaging machine, these guide plates 21 according to the present invention are for the purpose of causing the film material S to pass through their interior space and to be outwardly stretched by adsorption onto their internal surfaces. Thus, after the film material S is transformed into the shape of a cylinder by means of the former 103, it is adsorptively held from outside while it is gradually pulled downward towards the horizontal sealer 105 below.

For the purpose of gradually pulling down the film material S thus adsorbed onto the inner surfaces of the guide plates 21, the pair of pull-down belts 30 is disposed adjacent the guide plates 21 so as to come into contact with the film material S through vertically elongated windows 23 provided through the guide plates 21. As shown in FIG. 3, the pull-down belts 30 are provided with many openings 31 such that the film material S ca be effectively adsorbed outwardly into the shape of a tube by the negative pressure generated by suction vacuum chambers 25 provided as shown in FIGS. 2 and 3. Each pull-down belt 30 is stretched over an upper driver pulley 32, an idler 33 and a lower follower pulley 34. The lower follower pulleys 34 are disposed radially further outward from the upper driver pulley 32 such that adsorptive force due to the negative pressure created by the suction vacuum chambers 25 can be uniformly communicated to the film material S without wrinkling it while it is pulled down along the skirt section 22 by changing its sectional shape to an ellipse as it approaches the horizontal sealer 200.

Each suction vacuum chamber 25 is box-shaped and is open (that is, has holes) on the side surface facing the film material S and is disposed inside the traveling path of one of the pull-down belts 30. As shown schematically by the block diagram portion of FIG. 2, each suction vacuum chamber 25 is connected to a vacuum pump 35 through a suction pipe 36. A branch pipe 39 is attached to this suction pipe 36 to connect it through a check valve 37 to an auxiliary vacuum chamber 38. Another branch pipe 41 is attached to the suction pipe 36 to connect it through a generally closed magnetic valve 40 to the auxiliary vacuum chamber 38. A pressure sensor 42 is provided for the suction pipe 36 such that the magnetic valve 40 is opened, if an abnormal increase is detected in the pressure inside the suction vacuum chamber 25, so as to make use of the negative pressure inside the auxiliary vacuum chamber 38 to temporarily exert a large suction force into the suction vacuum chamber 25 and to thereby prevent the film material S from becoming separated from the surface of the pull-down belt 30 or to quickly return the already separated film material S to the adsorbed condition.

Figure 4:
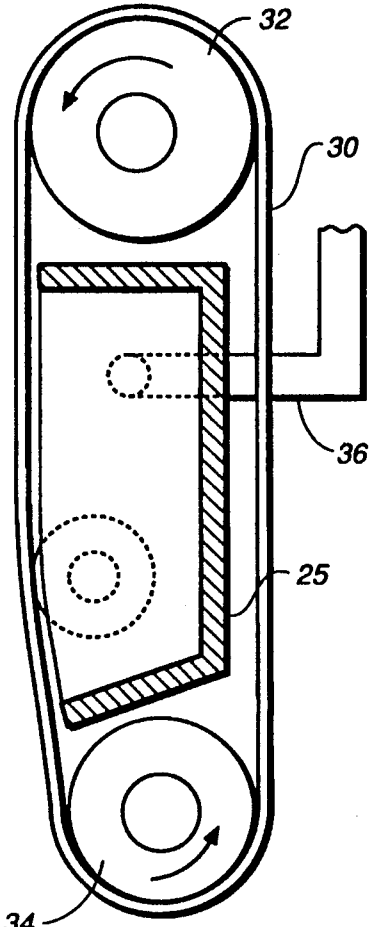
FIG. 4 is an enlarged view of a portion of FIG. 2 showing exaggeratedly the curvature on the inwardly facing surface of the suction vacuum chamber according to a preferred embodiment of the invention.

Although it is not apparent in FIG. 2 or 3, the inner surfaces of the suction vacuum chambers 25 are not completely flat but curved and convex. This is because the pull-down belts 30 are not completely flexible but possess some rigidity. When they are stretched between pulleys, therefore, they are not completely straight between the supporting pulleys but protrude somewhat outward as shown exaggeratedly in FIG. 4. If the inwardly facing surfaces of the suction vacuum chambers were completely flat, this would tend cause air to leak where the belts are not straight but bend outward. In order to straighten the belts, a rather large tension would be required in the belts. According to a preferred embodiment of the invention, therefore, the inwardly facing surfaces of the suction vacuum chambers 25 are curved and convex according to the rigidity of the pull-down belts 30.

Next, the operation of the apparatus described above is briefly explained. The film-material S pulled out of and transported from a film supply roll is transformed into a tubular shape by means of the former 900 and, as it is introduced inside the pair of guide plates 21, the pull-down belts 30 having openings 31 therethrough and being stretched between the upper driver pulley 32 and the lower follower pulley 34 serve to exert the negative pressure inside the suction vacuum chambers 25 onto the film material S such that film material S in a tubular form is adsorbed to the arcuate inner surfaces of the guide plates 21 while it is pulled down towards the horizontal sealer 105 by the motion of the pull-down belts 30.

The skirt parts 22 of the guide plates 21 transform the tubular film material S into an elliptical cross-section shape so as to prevent wrinkling when the film material S is sealed horizontally by the horizontal sealer 105. The idler pulleys 33 serve to keep the pulled down film material in contact with the inner surfaces of the skirt parts 22. In other words, the film material S which has a nearly circular cross section when it is first introduced at the top parts of the guide plates 21 is gradually transformed so as to have a very flat elliptical cross-sectional shape so that wrinkles are not generated easily when the horizontal sealer 105 is operated.

As the bag-shaped film material S is transported to the horizontal sealer 105, if it becomes separated from the pull-down belts 30 due to an impulsive force received when articles are dropped thereinto or due to wrinkles developed therein, the pressure inside the suction vacuum chambers 25 increases suddenly and such a sudden increase in pressure is immediately detected by the pressure sensor 42 which, in response, opens the generally closed magnetic valve 40 such that the negative pressure inside the auxiliary vacuum chamber 38 is quickly and temporarily transmitted to the suction vacuum chambers 25. The film material S is restored to the normal adsorbed condition immediately by the strong suction force which is thereby generated. As soon as the film material S is completely attached to the pull-down pulleys 30 and a vacuum condition is restored in the suction vacuum chambers 25, the magnetic valve 40 closes the branch pipe 41 and the pressure inside the auxiliary vacuum chamber 38 is reduced again by the operation of the vacuum pump 35 in preparation for another abnormal situation.

Although the auxiliary vacuum chamber 38, as auxiliary means for generating a negative pressure, was described above as a part of the apparatus, this is not intended to limit the invention. In a factory where such an auxiliary means for generating a negative pressure is already available, for example, the branch pipe 41 from the suction pipe 36 may be connected to such means so as to provide an even larger suction force when the film material S becomes separated from the pull-down belts 30.

Figure 5:
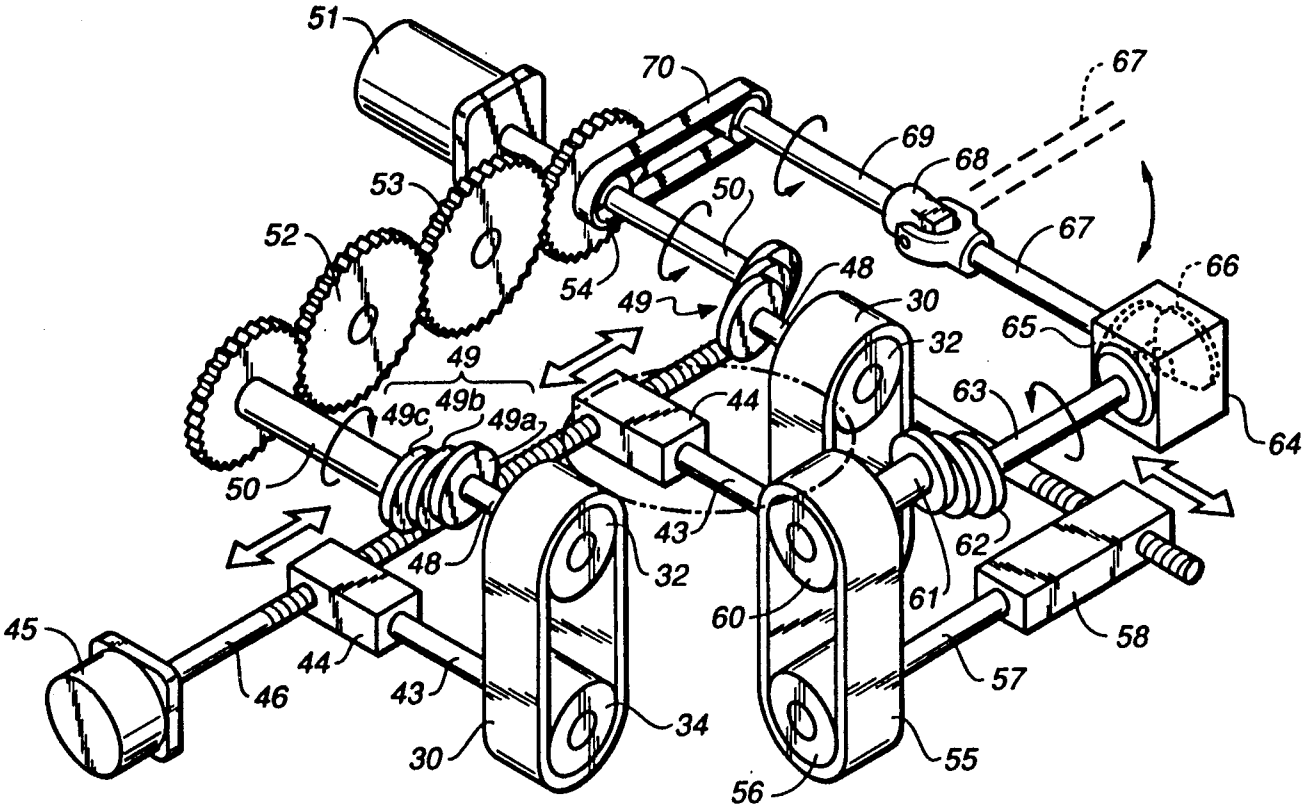
FIG. 5 is a schematic diagonal view of the motion-communicating part of an apparatus embodying the present invention.

Means for driving the pull-down belts 30 according to the invention are described next with reference to FIG. 5 wherein the components such as the pull-down belts 30 which have already been described above in connection with FIGS. 1, 2 and 3 are indicated by the same numerals. As shown in FIG. 5, the shafts (shown at 43) of the lower follower pulleys 34 for the pull-down belts 30 are each rotatably supported by an axle bearing 44 and these two axle bearings 44 engage the right-hand screw and left-hand screw parts of a turnbuckle 46 which is operated by a separation-adjusting servo motor 45 such that the separation between the two pull-down belts 30 can be adjustably varied by operating the separation-adjusting servo motor 45. It is preferred that the lead angle of the screws on the turnbuckle 46 be sufficiently large such that, when the servo motor 45 is not operating, the two pull-down belts 30 can be manually pushed away from each other, for example, when the film material is being set.

Each of the shafts (shown at 48) of the upper driver pulleys 32 for the pull-down belts 30 is connected through a Schmidt couplings 49 to a corresponding one of a pair of mutually parallel drive shafts 50 which are both in power-communicating relationship with a belt-driving servo motor 51 such that they rotate in opposite directions by means of two idlers 52 and 53 disposed therebetween. What is herein referred to as a Schmidt coupling is a device comprising rotary disks and links therebetween for transmitting torque in a transverse direction. It is described, for example, in Japanese Patent Publication Kokoku 44-19486 published Aug. 23, 1969 (based on U.S. patent application Ser. No. 406,696 filed Oct. 27, 1964). It is therefore assumed known and will not be described herein. In FIG. 5, each Schmidt coupling 49 is schematically drawn as a linked set of three disks 49*a*, 49*b* and 49*c*, the first of these disks (49*a*) being affixed to the shaft 48 of the upper driver pulley 32 and the third of these disks (49*c*) being affixed to the drive shaft 50.

The vertical-seal belt 55 is stretched over an upper driver pulley 60 and a lower follower pulley 56. The shaft (shown at 57) of the lower follower pulley 56 is axially supported by an axle bearing 58 which engages a screw axis 59 so as to be movable therealong. The screw axis 59 extends perpendicularly to the turnbuckle 46 and engages therewith through bevel gears (not shown) such that the vertical-seal belt 55 can be moved towards or away from the center of the tubular film material (schematically indicated by a dotted circular line in FIG. 5) in coordination with the pull-down belts 30. The shaft (shown at 61) of the upper driver pulley 60 is connected through a Schmidt couplinq 62 in a torque-communicating relationship to a driver shaft 63 which, in turn, is in a motion-communicating relationship with a linking shaft 67 through bevel gears 65 and 66 in another gear box 64. The linking shaft 67 is connected through universal joint 68 to another linking shaft 69 adapted to be driven by means of a timing belt 70 stretched over a pulley 54 affixed to the drive shaft 50 of the belt-driving servo motor 51. Although not shown in FIG. 5, the screw axis 59 includes a clutch where it corresponds to the universal joint 68 such that the part of the mechanism shown in FIG. 5 supporting the vertical-seal belt 55 can swing around the universal joint 68 such that the linking shaft 67 will be at a retracted position indicated by two parallel dotted lines.

Figure 6:
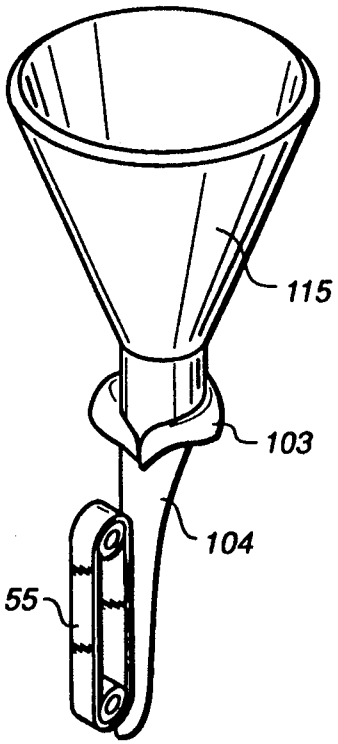
FIG. 6 is a diagonal view of an apron-shaped piece disposed opposite the vertical-seal belt.

When the separation-adjusting servo motor 45 is activated, both the turnbuckle 46 and the screw axis 49 are rotated because they are in motion-communicating relationship with each other through bevel gears (not shown) as explained above. The two pull-down belts 30 and the vertical-seal belt 55 are thereby moved radially outward or inward with respect to the central axis of the tubular film material in a mutually coordinated manner. Although omitted from FIGS. 1 and 5 for the sake of simplicity, there is an apron-like piece downwardly protruding from the former 103 as shown at 104 in FIG. 6. The external surface of this apron-like piece 104 is contoured such that the film material S which is wrapped around the former 103 will smoothly and naturally slide thereover as it is transformed into a tubular shape and the two edge sections which are overlapped one on top of the other will be guided opposite the vertical-seal belt 55. Thus, the pressure applied on the film material S for its vertical sealing by the vertical-seal belt 55 can be controlled by adjusting the operation of the separation-adjusting servo motor 45.

If the belt-driving servo motor 51 is activated next, the two drive shafts 50 deliver through the Schmidt couplings 49 the same torque to the shafts 48 of the upper driver pulleys 32 for the pull-down belts 30 independently of the change in the separation between the two pull-down belts 30 effected by the operation of the separation-adjusting servo motor 45 as described above, thereby pulling down the film material S. Concurrently with the above, the same rotary motion of the drive shaft 50 is communicated through the timing belt 70, the linking shafts 67 and 69 connected by the universal joint 68 and the bevel gears 65 and 66 to the driver shaft 63. The driving torque of this driver shaft 63 is similarly communicated to the upper driver pulley 60 to move the vertical-seal belt 55 at the same speed as the pull-down belts 30 independently of the change in the position of the vertical-seal belt 55 effected by the controlled operation of the separation-adjusting servo motor 45.

When a new film material is set or when the position of the film material in position needs to be corrected, for example, the separation-adjusting servo motor 45 may be rotated in the reverse direction to move the pull-down belts 30 and the vertical-seal belt 55 away from each other or, as explained above, this may be accomplished manually without activating the separation-adjusting servo motor 45. After a locking device (not shown) is released, the part of the mechanism supporting the vertical-seal belt 55 and its pulleys 56 and 60 may be rotated around the universal joint 68 to a retracted position as explained above to make the film material S even more accessible.

The present invention has been described above by way of a preferred embodiment but this is not intended to limit the scope of the invention. Many modifications and variations are possible within the scope of the invention. For example, although one of the objects of the present invention has been to provide a form-fill-seal packaging machine without the use of a loading cylinder and an apparatus for driving its pull-down belts was illustrated for such a machine, it should be easily to realize that the apparatus can be used equally effectively with a machine using a loading cylinder of the conventional type.

Figure 7:
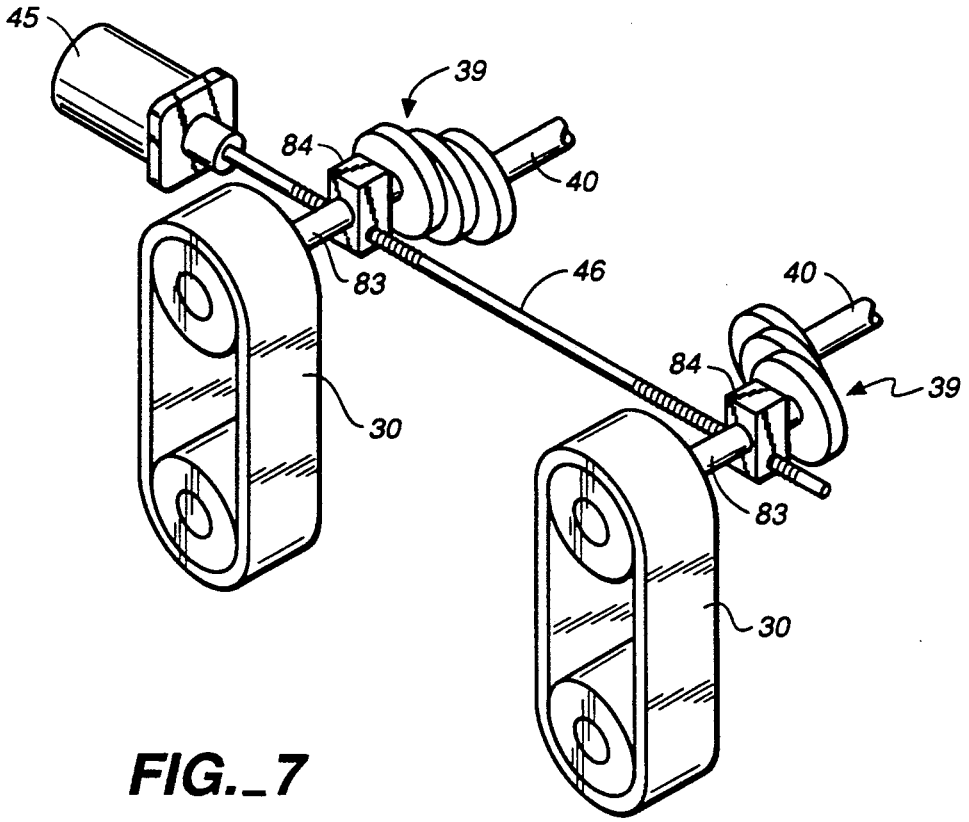
FIG. 7 is a diagonal view of a portion of another apparatus embodying the invention.

Another mechanism embodying the present invention for operating pull-down belts is shown in FIG. 7 wherein comparable or equivalent components are indicated by the same numerals as used above. The mechanism shown in FIG. 7 is characterized as having a pair of axle bearings 84 each axially supporting the shaft 83 of one of the pulleys supporting a pull-down belt 30 and engaging with the left-hand and right-hand screw parts of the turnbuckle 46 driven by the separation-adjusting servo motor 45. These pulley shafts 83 are each connected through a Schmidt coupling 89 to one of the drive shafts 50 in motion-communication relationship with the belt-driving servo motor 51 (not shown in FIG. 7).

Although an apparatus was shown above wherein a single belt-driving servo motor is used to drive not only the two pull-down belts but also the vertical-seal belt, neither is this feature intended to limit the scope of the invention. In fact, there are advantages in using separate motors to drive these three belts. When the outer surfaces of the pull-down belts 30 have been unequally deformed, for example, they will tend to twist the film material because they ma effectively be pulling the material at different rates. By driving the two belts 30 independently in such a situation, it becomes possible to smoothly pull down the film material even after the surface conditions of the belts 30 have changed differently.

Figure 8:
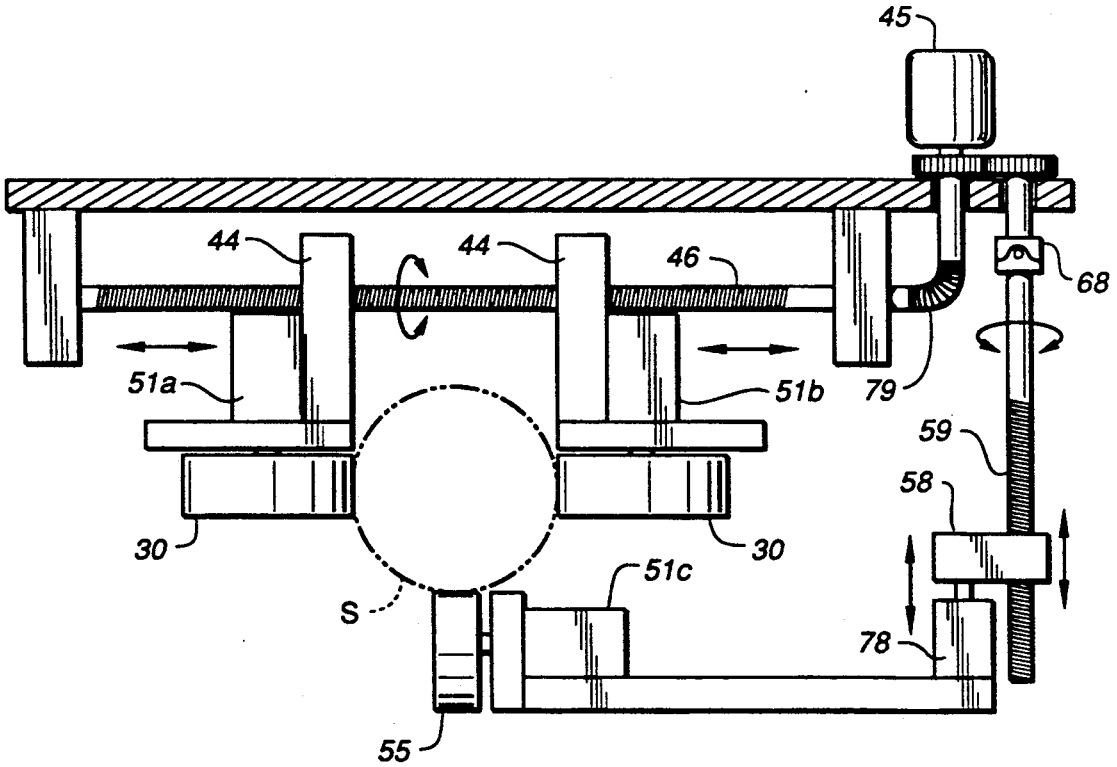
FIG. 8 is a schematic plan view of still another apparatus embodying the invention.

FIG. 8, in which comparable components are again indicated by the same numerals used above, illustrates still another apparatus embodying the invention characterized wherein the two pull-down belts 30 and the vertical-seal belt 55 are each provided with its own belt-driving servo motor 51*a*, 51*b* and 51*c* such that the two pull-down belts may be operated at different rates, depending on their differently deformed conditions as explained above. As schematically shown in FIG. 8, the drive shaft of each of the three belt-driving motors 51*a*, 51*b* and 51*c* is rotatably supported by a member either directly affixed to one of the axle bearings 44 engaging the turnbuckle 46 or affixed through an air cylinder 78 to an axle bearing engaging the screw axis 59. Both the turnbuckle 46 and the screw 59 axis are in motion-communicating relationship with a single separation-adjusting servo motor 45 such that, although the three belts 30 and 55 can be driven at different rates, they can be moved radially towards or away from the center of the tubular form of the film material S at the same rate. The air cylinder 78, through which the vertical-seal belt 55 is supported by the axle bearing 58, serves to retract the vertical seal belt 55 away from its normal position in contact with the film material S, for example, when the operation of the pull-down belts 30 are stopped. According to a preferred mode of operating the apparatus, the belt-driving servo motor 51*c* for the vertical-seal belt 55 is not stopped when the pull-down belts 30 are stopped temporarily for whatever reason but the air cylinder 78 is activated at the same time so as to remove the vertical-seal belt 55 away from the film material S. In this manner, the vertical-seal belt 55 remains uniformly heated while the pull-down belts 30 are temporarily stopped such that, when the pull-down belts 30 are restarted and the vertical-seal belt 55 is made to contact the film material S again by the operation of the air cylinder 78, the uniformly heated vertical-seal belt 55 can perform the vertical sealing of the film material S evenly without any irregularities. In FIG. 8, numeral 78 indicates a flexible coupling means for communicating torque.

The present invention has been described above by way of only a few embodiments but they are not intended to limit the scope of the invention. By comparing FIG. 8 with FIG. 5, for example, a person skilled in the art will realize that different combinations of motion-communicating and torque-communicating means can be substituted. Such modifications and variations that may be apparent to a person skilled in the art are intended to be included within the scope of the invention.

What is claimed is:

1. A film-pulling apparatus for a form-fill-seal packaging machine, comprising:

cylinder-forming means for receiving an elongated flexible thermoplastic sheet and forming said sheet into a cylindrical form;

guiding means having inner surfaces for guiding a cylindrically formed sheet along a predetermined path over said inner surfaces, said inner surfaces having openings and an arcuate cross-sectional shape perpendicular to said path;

endless pull-down belts having a large number of holes therethrough and disposed along said path;

suction vacuum chambers disposed adjacent said pull-down belts and proximal said path such that a negative pressure from said suction vacuum chambers is normally exerted on a sheet at said path through said holes in said pull-down belts and through said openings in said guiding means;

pressure-detecting means for detecting pressure condition inside said suction vacuum chambers; and control means for keeping the interior of said suction vacuum chambers in reduced pressure condition and responding to an abnormal pressure condition detected through said pressure-detecting means by quickly causing said reduced pressure condition to be restored inside said suction vacuum chambers.

2. The apparatus of claim 1 wherein the arcuate cross-sectional shape of said guiding means changes gradually, being circular near said cylinder-forming means and being elliptical at positions farther away therefrom.

3. The apparatus of claim 1 wherein said suction vacuum chambers have a curved contact surface with said pull-down belts along said path.

4. The apparatus of claim 1 wherein said control means include an auxiliary vacuum chamber normally maintained in a vacuum condition and a normally closed valve means connecting said suction vacuum chambers with said auxiliary vacuum chamber, said normally closed valve being adapted to open when an abnormal pressure condition is detected by said pressure-detecting means.

5. A film-handling apparatus for a form-fill-seal packaging machine comprising:

a parallel-running pair of endless pull-down belts stretched between pulleys for contacting and thereby pulling an elongated bag-making film material in a first direction;

separation-adjusting means for controllably varying the separation in a second direction between said pull-down belts, said second direction being perpendicular to said first direction; and belt-driving means for causing said pull-down belts to rotate;

said separation-adjusting means including a first axle bearing and a second axle bearing respectively supporting rotatably said pulleys of said pull-down belts and motion-converting means for converting a rotary motion into mutually opposite linear motions of said first and second axle bearings in said second direction.

6. The apparatus of claim 5 wherein said motion-converting means include a turnbuckle having right-hand and left-hand screw parts, said first and second axle bearings engaging respectively said right-hand and left-hand screw parts.

7. The apparatus of claim 5 wherein said belt-driving means include a single belt-driving motor and a Schmidt coupling adapted to communicate torque from said belt-driving motor to at least one of said pulleys for one of said pull-down belts.

8. The apparatus of claim 6 further comprising a heat belt stretched in said first direction between pulleys, said separation-adjusting means further serving to move said heat belt in a third direction according to the separation between said pull-down belts, said third direction being perpendicular to both said first and second directions.

9. The apparatus of claim 8 wherein said separation-adjusting means further include a screw bar which extends in said third direction and is in torque-communicating relationship with said turnbuckle, said screw bar having a third axle bearing engaged thereon such that said third axle bearing moves in said third direction as said screw bar rotates, said third axle bearing supporting said heat belt.

10. The apparatus of claim 6 wherein said right-hand and left-hand screw parts are so designed that said first and second axle bearings which engage therewith can be manually moved away from each other in said second direction.

11. The apparatus of claim 10 wherein said belt-driving means include three independently controllable motor means individually associated to and adapted to drive said pull-down belts and said heat belt.

12. The apparatus of claim 11 wherein said separation-adjusting means further including retracting means for retractingly moving said heat belt in said third direction independently of the change in the separation between said pair of pull-down belts.

13. The apparatus of claim 12 wherein said retracting means include an air cylinder supported by said third axle bearing.

* * * * *